US010640270B2

(12) United States Patent
Port et al.

(10) Patent No.: US 10,640,270 B2
(45) Date of Patent: May 5, 2020

(54) CLOSURE MECHANISM THAT PREVENTS ACCIDENTAL INITIAL OPENING OF A CONTAINER

(71) Applicant: The Procter & Gamble Company, Cincinnati, OH (US)

(72) Inventors: Markus Port, Steinbach (DE); Ibrahim Ulas, Steinbach (DE)

(73) Assignee: The Procter and Gamble Plaza, Cincinnati, OH (US)

( * ) Notice: Subject to any disclaimer, the term of this patent is extended or adjusted under 35 U.S.C. 154(b) by 0 days.

(21) Appl. No.: 15/718,645

(22) Filed: Sep. 28, 2017

(65) Prior Publication Data

US 2018/0086521 A1 Mar. 29, 2018

Related U.S. Application Data

(60) Provisional application No. 62/400,931, filed on Sep. 28, 2016.

(51) Int. Cl.
*B65D 55/06* (2006.01)
*B65D 47/08* (2006.01)

(52) U.S. Cl.
CPC ..... *B65D 55/06* (2013.01); *B65D 47/0857* (2013.01); *B65D 2101/00* (2013.01)

(58) Field of Classification Search
CPC ..... B65D 55/06; B65D 47/0857; B65D 2101/00; B65D 43/169; B65D 43/13; B65D 55/16; B65D 51/18; B65D 51/24
(Continued)

(56) References Cited

U.S. PATENT DOCUMENTS 2,138,560 A 11/1938 Kimberly
D154,552 S 7/1949 Lauby
(Continued)

FOREIGN PATENT DOCUMENTS

AU 645214 2/1993
BQ BX25863-012 9/1995
(Continued)

OTHER PUBLICATIONS

Berns, Applied Ergonomics, 1981, Ann Arbor Science Publishers Inc., Chap. 12.3, pp. 153-161.*
(Continued)

*Primary Examiner* — Kareen K Thomas
(74) *Attorney, Agent, or Firm* — Linda M. Sivik

(57) ABSTRACT

The present invention is directed toward providing container closure structures that include at least one breakable or irreversibly deformable engagement element. Specifically, a closure having at least one engagement element that is breakable or irreversibly deformable upon application of an opening force that is equal to, or higher than, a threshold force value, wherein the closure comprises one or more moveable parts and one or more fixed parts; and wherein the engagement element engages the moveable part and the fixed part of the closure; and wherein the mechanical part inhibits the separation between the moveable and the fixed part of the closure upon application of opening force below the threshold force value; and sealing together the moveable part and the fixed part of the closure at one or more locations; a breakable splint which connects the moveable and fixed parts of the closure created by a two step molding process.

18 Claims, 6 Drawing Sheets

(58) Field of Classification Search
USPC .... 220/114, 254.3, 254.1, 254.9, 259.1, 212, 220/265, 266; 215/243, 237, 235, 228, 215/250, 254, 253; 222/568, 567, 562, 222/559
See application file for complete search history.

(56) References Cited

U.S. PATENT DOCUMENTS

D158,396 S 5/1950 Libson
2,571,833 A 10/1951 Chidsey, Jr.
2,889,087 A * 6/1959 Paull ..... B65D 51/04 222/498
3,045,860 A * 7/1962 Desgagne ..... B65D 51/04 220/254.3
3,237,571 A 3/1966 Corsette
3,331,500 A 7/1967 Jules
3,341,005 A 9/1967 Jules
3,362,344 A 1/1968 Duda
D219,643 S 1/1971 Garbus
3,583,605 A * 6/1971 Corsette ..... B05B 11/3023 222/321.9
3,591,298 A 7/1971 Green
3,968,914 A 7/1976 Goncalves
4,172,540 A * 10/1979 Erichson ..... B65D 47/0819 222/517
4,344,545 A * 8/1982 Aschberger ..... B65D 47/141 206/807
4,357,905 A 11/1982 Carpenter
4,359,166 A 11/1982 Dubach
4,369,899 A 1/1983 Magers
4,371,088 A * 2/1983 Gach ..... B65D 55/02 215/220
4,371,099 A 2/1983 Foster
4,431,110 A * 2/1984 Roth ..... B65D 47/0838 215/213
4,462,504 A * 7/1984 Roth ..... B65D 47/0838 215/235
4,545,495 A * 10/1985 Kinsley ..... B65D 47/0814 215/235
4,609,114 A 9/1986 Roy
4,625,898 A * 12/1986 Hazard ..... B65D 47/0819 215/235
4,640,427 A 2/1987 Marino et al.
4,666,068 A * 5/1987 Bush ..... B65D 47/0885 16/224
4,711,372 A * 12/1987 Gach ..... B65D 47/0885 206/807
4,749,108 A * 6/1988 Dornsbusch ..... B65D 47/043 222/212
D306,220 S 2/1990 Wang
D310,027 S 8/1990 Bixler
4,948,002 A * 8/1990 Thornock ..... B65D 50/046 215/216
D311,487 S 10/1990 Platt
4,991,746 A 2/1991 Schultz
5,108,029 A * 4/1992 Abrams ..... B65D 5/746 220/266
5,180,088 A 1/1993 De
5,191,975 A 3/1993 Pezzoli
D342,023 S 12/1993 Bonkowski
D353,232 S 12/1994 Chrisco
5,524,793 A 6/1996 Oneill
5,570,818 A 11/1996 Strong
5,715,973 A 2/1998 Foster
5,738,250 A 4/1998 Gillingham
5,829,641 A 11/1998 Bartsch
5,853,093 A * 12/1998 Neiger ..... B65D 41/0471 215/237
6,039,181 A 3/2000 Whiteside
6,216,905 B1 * 4/2001 Mogard ..... B65D 5/746 220/266
6,230,942 B1 5/2001 Kuo
6,283,332 B1 9/2001 Ragno
6,357,629 B1 3/2002 Ding
6,364,167 B1 4/2002 Safian
6,604,656 B1 8/2003 Tseng
D502,406 S 3/2005 Eddings
D504,197 S 4/2005 Huthmaker
7,204,383 B2 4/2007 Hsu
H2203 H 10/2007 Burchardt et al.
7,658,295 B2 * 2/2010 Hoepner ..... B65D 47/0885 215/235
D618,861 S 6/2010 Bahnean
7,854,351 B2 12/2010 Bougamont
8,297,438 B2 10/2012 Crossman
8,403,181 B2 3/2013 Ding
D717,006 S 11/2014 Alfonso
8,910,817 B2 * 12/2014 Kanderka ..... B65D 75/12 220/266
D722,891 S 2/2015 Borg
D744,819 S 12/2015 Dalisay
9,908,132 B2 3/2018 Dalisay
10,099,823 B2 10/2018 Kawamura
2003/0062369 A1 * 4/2003 Hierzer ..... B65D 47/0804 220/259.1
2005/0045641 A1 3/2005 Doran
2005/0139500 A1 6/2005 Smithers
2006/0011573 A1 * 1/2006 Herald ..... B65D 47/0804 215/237
2006/0201905 A1 9/2006 Perrin et al.
2008/0264961 A1 * 10/2008 Sawyer ..... B65D 47/0814 220/810
2009/0101662 A1 4/2009 Marco
2009/0194501 A1 * 8/2009 Yamanaka ..... B65D 47/0814 215/235
2010/0243511 A1 9/2010 Nicholls
2011/0297700 A1 12/2011 Santagiuliana
2014/0311943 A1 10/2014 Snyder
2016/0167840 A1 * 6/2016 Kleppsch ..... B65D 41/04 215/251
2016/0172742 A1 * 6/2016 Forster ..... B65D 41/0471 215/237
2018/0086521 A1 3/2018 Port
2018/0127179 A1 5/2018 Port
2019/0152682 A1 5/2019 Agerton
2019/0152684 A1 5/2019 Bartolucci

FOREIGN PATENT DOCUMENTS

BQ BX27419-001 1/1997
CN 3670544 7/2007
DE 2911988 A1 10/1980
EP 0381516 A2 2/1990
EP 1512634 A1 3/2005
EP 1122183 B1 4/2005
FR 2702739 B1 6/1995
FR 2743054 B1 7/1997
GB 468762 A 7/1937
GB 3001453 3/2002
GB 2512620 A 10/2014
JP D1061476 2/2000
JP 5282241 B2 9/2013
WO WO9524345 A1 9/1995
WO WO0134471 A1 5/2001

OTHER PUBLICATIONS

AcaiBerry.com eco bottle packaging, google publish date Dec. 8, 2010, online, http://www.acaiberry.com/company.html, [site visitied Jun. 29, 2015 2:39:05 PM].
All final and non-final office actions for U.S. Appl. No. 14/689,569.
All final and non-final office actions for U.S. Appl. No. 15/718,616.
All final and non-final office actions for U.S. Appl. No. 16/194,503.
All final and non-final office actions for U.S. Appl. No. 16/194,510.
All final and non-final office actions for U.S. Appl. No. 29/471,542.
Can Carrier—Dylan Macnab Portfolio, upload May 2013, online, http://cargocollective.com/dylanmacnab/Can-Carrier, [site visited Jun. 29, 2015 6:25:33 PM].
European Search Report for EP17203314.4 dated Nov. 4, 2018.

(56) References Cited

OTHER PUBLICATIONS

Howies Hockey Water Bottle Carrier, website copyright 2013, line, http://howieshockeytape.com/store/hockey-team-water-bottles/Hockey-Water-Bottle-Carriers, [site visited Jun. 29, 2015 6:35:14 PM].
PCT International Search Report and Written Opinion for PCT/US2016/027779 dated Jul. 25, 2016.
PCT International Search Report and Written Opinion for PCT/US2017/053873 dated Dec. 6, 2017.
PCT International Search Report and Written Opinion for PCT/US2018/058655 dated Feb. 18, 2019.
PCT International Search Report and Written Opinion for PCT/US2018/058656 dated Feb. 18, 2019.
European Search Report for EP17203313.6 dated Dec. 4, 2018.

* cited by examiner

CLOSURE MECHANISM THAT PREVENTS ACCIDENTAL INITIAL OPENING OF A CONTAINER

FIELD OF THE INVENTION

The present invention relates to a mechanism that prevents accidental initial opening of a container. The mechanism includes at least one engagement element that engages the moveable part of the containers closure with the fixed part of the closure. This engagement element breaks or irreversibly deforms during the first opening of the container. The additional force required to break or to irreversibly deform the engagement element and to open the container during the first opening mitigates the risk of accidental opening during shipment or storage of the goods. The engagement element may be invisible to the user of the product. Once broken or irreversibly deformed during the first opening, the engagement element does not interfere with the subsequent opening and closing cycles of the container by the consumer.

BACKGROUND OF THE INVENTION

Liquid fast moving consumer goods like shampoo, body wash, dish detergent or laundry detergent are usually sold in rigid plastic containers. These containers are produced in mass scale and usually follow a simple technology approach and design for economic reasons. The pack material is usually produced at a step prior to the filling of the container. The final sellable unit needs to be securely closed to ensure safe shipment without any leaking of the contained liquid. In most cases, the orifice used for filling at the manufacturing site is identical to, or at least close to, the orifice designed for the usage phase at the consumer's home. This does not normally apply to tubes, which are permanently sealed after the filling process while the intended consumer dispensing orifice is located at the opposite end to the filling position. Most standard bottled liquids in plastic containers are closed by a plastic cap (also referred as a closure or a closure assembly) that is attached to the container after the filling of the bottle at the manufacturer and is either screwed on, snapped on or sealed on. All caps snapped or sealed onto the bottle usually come with a moveable feature. Examples of caps that have a moveable feature are flip top or disc top closures. These caps allow consumers to open the bottle and dispense the product in a controlled way, while the cap's main part remains attached to the bottle.

The closure is desired to be designed in such a way so that, during the use of the product, it can be readily opened and closed by the consumer without requiring excessive amount of force. However, closures that can be readily opened using weak forces are occasionally accidentally and undesirably opened during product manufacturing, transportation and storage. Thus, there is a need for closures that (1) require increased amount of force for the initial opening and (2) require relatively low force for opening and closuring of the container after its initial opening and during the regular use by the consumer. In other words, the closure needs to provide tightness under manufacturing, transportation and storage conditions, while it allows the consumer of the product to readily open the container, dispense part of its content and close the container when needed. Part of the performance of the closure can be defined by these two fundamentally different requirements, that is, being tight before the initial opening and easy to open afterwards.

BRIEF SUMMARY OF THE INVENTION

The present invention fulfills the need described above by providing container closure structures, for example closures that include at least one breakable or irreversibly deformable engagement element. Specifically, a closure having at least one engagement element that is breakable or irreversibly deformable upon application of an opening force that is equal to, or higher than, a threshold force value, wherein the closure comprises one or more moveable parts and one or more fixed parts; and wherein the engagement element engages the moveable part and the fixed part of the closure; and wherein the engagement element is selected from a group consisting of a mechanical part which is attached to the moveable part or the fixed part of the closure and wherein the mechanical part inhibits the separation between the moveable and the fixed part of the closure upon application of opening force below the threshold force value; and sealing together the moveable part and the fixed part of the closure at one or more locations; a breakable splint which connects the moveable and fixed parts of the closure created by a two step molding process wherein (1) the first step results in a closure that includes a hollow space which spans in both the moveable and the fixed parts of the closure at a closed position and wherein (2) the second step includes the filling of the hollow space with liquid plastic which solidifies or hardens upon cooling or upon thermosetting.

BRIEF DESCRIPTION OF THE DRAWINGS

FIG. 5A is a base (2) and a movable flip top (1) closure after first injection during the molding process. FIG. 5B is a base (2) and a movable flip top (1) in closed state after first injection. FIG. 5C is a base (2) and a movable flip top (1) in closed state after a second injection during the molding process, breakable splint (7) is created and connects the base and movable flip top (1). FIG. 5D is a base (2) and a movable flip top (1) in open state after initial opening, where breakable splint (7) is broken at defined force, and any subsequent opening will follow the normal default opening force.

DETAILED DESCRIPTION OF EMBODIMENTS OF THE INVENTION

Figure 1:
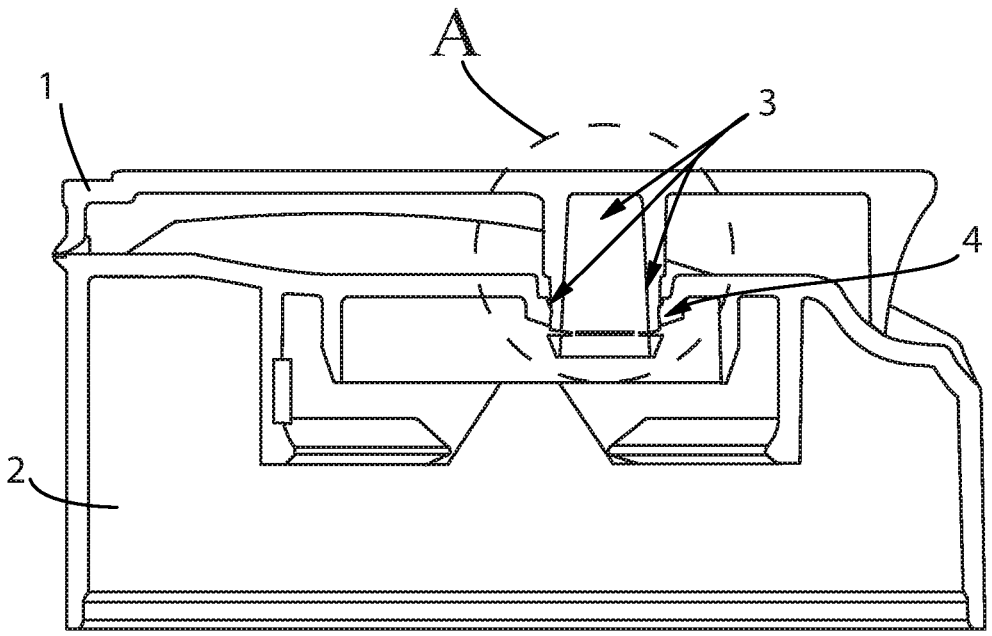
FIG. 1 is a cross-section view of a mushroom pin (3) with the mushroom pin (3) tip inserted through the orifice (4) and expanded inside. The opening of the movable flip top (1) results in tip tearing off the mushroom pin (3) at the designed breaking points.
Figure 2:
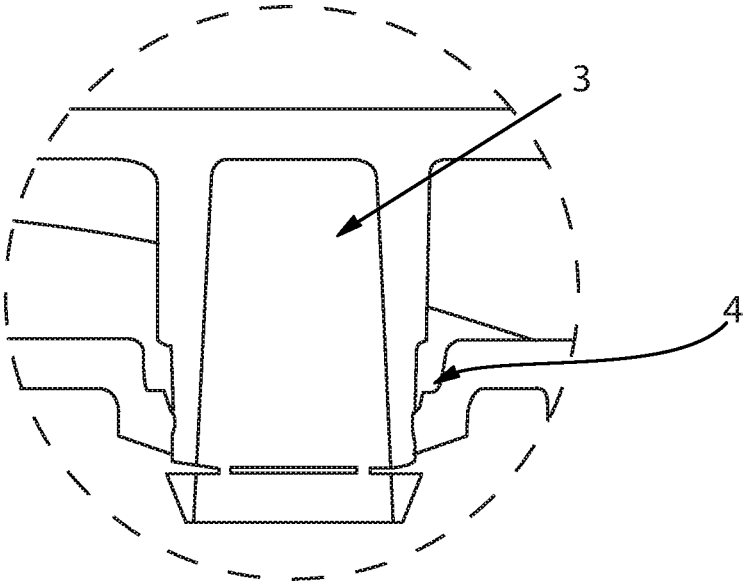
FIG. 2 is an enlarged view of the mushroom pin (3) and orifice (4), as shown in FIG. 1 at A.

All percentages and ratios used herein are by weight of the total composition, unless otherwise designated. All measurements are understood to be made at ambient conditions, where "ambient conditions" means conditions at about 25° C., under about one atmosphere of pressure, and at about 50% relative humidity, unless otherwise designated. All numeric ranges are inclusive of narrower ranges; delineated upper and lower range limits are combinable to create further ranges not explicitly delineated.

A typical container for consumer goods includes either a flip top closure or a disc closure. A non-limiting example is a flip top closure, which has a pin (6), as an integral part of the moveable flip top (1), and an opening or orifice (4) on the base (2) of the closure, wherein the base (2) may be fixed to the container. Such closure mechanism will tighten the system, both in transit as well as in use. Alternatively, in the non-limiting example of a disc top closure (10), the moveable part can be a disc that is integrated into the body of the closure and rotates around an axis. This rotation of the moving part of the closure creates a channel connecting the contents of the container with the outside of the container so that the contents can be dispensed by the consumer. A typical method of making flip top and disc top closures includes injection molding of different plastics like polyethylene (PE), polypropylene (PP) or polyethylene terephthalate (PET).

Containers having closures with moveable parts are be readily opened and closed by the consumer during the product use. That is, the containers do not require excessive force for the routine opening and closing operation. However, the same container is desired be transported and stored safely without accidental opening and leaking of the liquid, before it reaches the consumer. Indeed, a problem that is occasionally encountered in containers that include closures having moving parts, such as flip top and disk closures, is the accidental opening of the container and product leakage during manufacturing, transportation and storage. The present invention has found that container closures can be designed and produced so that they are safely transported and stored with very low probability of accidental opening. Then, they can be readily opened and closed by the consumer during the regular use of the product by the consumer. This is achieved by using closures wherein the force required to open the container for the first time is significantly higher than the force required to open the container after the initial opening. More specifically, these closures use a mechanism that prevents the accidental initial opening of a container. The mechanism includes at least one engagement element that engages the moveable part of the closure with the fixed part of the closure. This engagement element breaks or irreversibly deforms during the first opening of the container. The additional force required to break or to irreversibly deform the engagement element and to open the container during the first opening significantly reduces the risk of accidental opening during shipment or storage of the goods. The engagement element is achieved by one or more of the following methods:

(a) By using a mechanical part that is attached to the moveable or to the fixed part of the closure, wherein the mechanical part inhibits the separation between the parts applying a force below a specific threshold, and wherein the mechanical part breaks or it is irreversibly deformed during the first opening of the container when a force above the threshold is applied;

(a) By sealing together the moveable part and the fixed part of the closure mechanism at one or more locations, where the two parts have contacting surfaces at the closed position of the closure. This can be achieved by welding, gluing, or taping of plastic surfaces of both parts. For the taping, a perforated adhesive film is used.

(c) By having a breakable splint (7) which connects the moveable and fixed parts of the closure. The splint is created by a two step molding process wherein (1) the first step results in a closure that includes a hollow space which spans in both the moveable and the fixed parts of the closure (at a closed position) and wherein (2) the second step includes the filling of the hollow space with liquid plastic which solidifies or hardens upon cooling or upon thermosetting.

The position of the breakable or deformable engagement element can be selected to be concealed so that the initial opening event is invisible to consumers and does not require any additional, conscious action by the consumers.

The mechanical part inhibits the separation between the parts applying a force below a specific threshold, and wherein the mechanical part breaks or it is irreversibly deformed during the first opening of the container when a force above the threshold is applied.

In an embodiment of the present invention, the ratio of the threshold force value to the required force to open the closure after the initial opening is larger than 1.25. In a further embodiment, wherein the ratio of the threshold force value to the required force to open the closure after the initial opening is larger than 1.5. In yet a further embodiment, the ratio of the threshold force value to the required force to open the closure after the initial opening is larger than 2. In a further embodiment, the ratio of the threshold force value to the required force to open the closure after the initial opening is larger than 3. In a further embodiment, the ratio of the threshold force value to the required force to open the closure after the initial opening is larger than 4. In a further embodiment, the ratio of the threshold force value to the required force to open the closure after the initial opening is larger than 5. In an embodiment, the threshold force required to open the closure for the first time is from about 12 N to about 50 N. In a further embodiment, the threshold force required to open the closure for the first time is from about 18 N to about 40 N. In yet a further embodiment, the threshold force required to open the closure for the first time is from about 20 N to about 35 N.

Mechanical Part Attached to Moveable or Fixed Closure Part

An embodiment of the present invention is a closure having an engagement element that engages the moveable part of the closure with the fixed part of the closure, wherein the engagement element is a mechanical part that is included in the moveable part of the closure. The presence of the mechanical part does not permit the separation between the moveable part and the fixed part of the closure, unless a force of sufficient magnitude is applied. Application of force of a magnitude below this threshold does not have any effect on the container if the container has not been opened before. Application of a force on the closure of a magnitude above this threshold value, breaks or irreversibly deforms the mechanical part, allowing the separation of the moveable and the fixed part of the closure, opening the container for the first time. After the first opening of the container, and after the mechanical part has been broken or deformed, the mechanical part does not have any effect on the closure, and the container can be opened with significantly reduced force. The mechanical connection can be located in different areas of the closure and it can be visible or concealed by the user.

One embodiment of the present invention is a pin-and-hole with movable flip top closure (1), wherein the lower part of the pin ends in a mechanical part having width larger than the width of the adjacent portion of the pin. This pin is referred as mushroom pin (3). During initial closing of the movable flip top (1) at the cap supplier the tip of the mushroom pin (3) is mechanically squeezed through the orifice (4) of the base (2) of the cap where it releases inside the hollow space of the cap base (2). In an embodiment of the present invention, the wider portion at the mushroom tip is squeezed through the orifice (4) during the initial movable flip top (1) closing process, after caps are produced at the cap maker. Once the mushroom tip is squeezed through and relaxed/expanded it cannot be pulled back in the same way given its interlocking with the orifice (4).

The wider portion of the mushroom pin (3), that is the mushroom pin (3) tip, is designed so that it will break or it will be irreversibly deformed during the first opening of the container. The breaking or irreversibly deforming of the mushroom pin (3) tip from the rest of the mushroom pin requires a specific force. The mushroom pin (3) can be designed so that a specific, predetermined force is required to initially open the container. Thus, this mechanism imparts the requirement for a relatively high force to open the container for the first time (preventing accidental opening of the container during manufacturing, transportation, storage or store display). After the intentional initial opening and the breaking or the irreversible deformation of the mushroom pin (3) tip, the force required for the subsequent openings and closings of the container will be significantly lower.

Figure 8A:
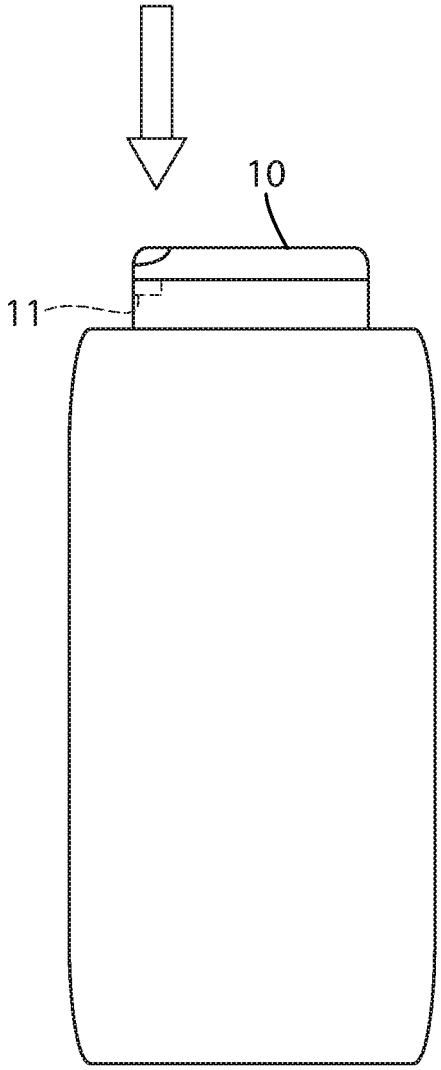
FIG. 8A is a view of a disc top closure (10) with a breakable mechanical part (11) in closed position.
Figure 8B:
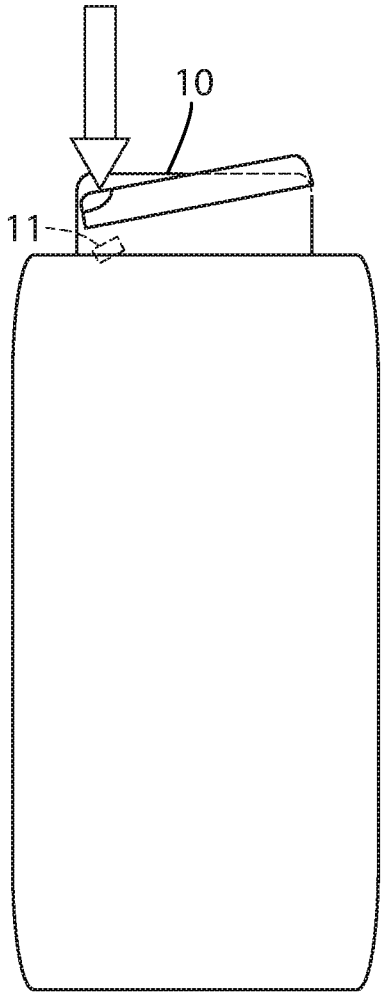
FIG. 8B is a view of disc top closure (10) with a breakable mechanical part (11) in an open position with the breakable mechanical part (11) detaching from the disc top closure (10).

Another embodiment of this option is a disk closure (10), wherein the closure includes a breakable mechanical part (11) attached to the fixed part of the closure located underneath the portion of the actuation point of the moveable part (disk) as shown in FIGS. 8A and 8B. The actuation point is the part of the disk which the consumer presses down in order to open the container closure. The breakable mechanical part (11) is intact when the closure is in the "close position" and the closure has never been opened. The mechanical part is designed so that it will break during the first opening of the container. The breaking of the breakable mechanical part (11) from the rest of the fixed part of the disc closure requires a specific force. The attachment of the breakable mechanical part (11) to the disc closure can be designed so that a specific, predetermined force is required to initially open the container. Thus, this mechanism imparts the requirement for a relatively high force to open the container for the first time (preventing accidental opening of the container during manufacturing, transportation, storage or store display). After the intentional initial opening and the breaking or the irreversible deformation of the breakable or deformable element, the force required for the subsequent openings and closings of the container will be significantly lower.

Another embodiment of this option is twist&lock closure, wherein the closure includes a breakable mechanical part attached to twistable part of the closure. The breakable mechanical part is connecting the fixed and the twistable part in the closed state of the closure and requires a force above the described threshold to break and allow the initial opening by the first twisting. Thus, this mechanism imparts the requirement for a relatively high force to open the container for the first time (preventing accidental opening of the container during manufacturing, transportation, storage or store display). After the intentional initial opening and the breaking or the irreversible deformation of the breakable or deformable element, the force required for the subsequent openings and closings of the container will be significantly lower.

Another embodiment of this option is a silicone valve closure, wherein the closure includes a breakable mechanical part attached to the fixed part of the closure. This fixed element prevents the access to the silicone valve until broken/irreversibly deformed during the first opening by the consumer. The moveable part typically chosen for silicone valve closures follows the design of a flip top or screw on cap, hiding the silicon orifice from the outside environment.

The breakable mechanical part is intact when the closure is in the "close position" and the closure has never been opened. The mechanical part is designed so that it will break during the first opening of the container. The breaking of the breakable mechanical part from the rest of the fixed part of the disc closure requires a specific force. The attachment of the breakable mechanical part to the cap shielding the silicon orifice from the environment can be designed so that a specific, predetermined force is required to initially open the container. Thus, this mechanism imparts the requirement for a relatively high force to open the container for the first time (preventing accidental opening of the container during manufacturing, transportation, storage or store display). After the intentional initial opening and the breaking or the irreversible deformation of the breakable or deformable element, the force required for the subsequent openings and closings of the container will be significantly lower.

Mushroom Pin (or Other Breakable Part) Materials and Process

In an embodiment of the present invention, non-limiting examples of common cap materials such as common injection molding materials such as PP, HDPE, PET may be used for the mushroom pin (3) material. Creation of the mushroom pin (3) or other breakable/deformable elements is based on standard plastic part production processes for injection molding. In these usually a defined plastic material is turned into liquid state by heating and injected under pressure into a defined hollow space, the mold. This mold structure defines the final 3D shape of the plastic part once the liquid plastic solidified after cooling and got released from the mold. The functionality of the moveable elements of the plastic part are defined both by the mechanical properties of the plastic (Polyolefines with defined chain length and defined mechanical properties) as well as the thickness and geometry of the moveable elements including the connecting hinges.

A. Sealing

An embodiment of the present invention is a disk top closure having an engagement element that engages the moveable part of the closure with the fixed part of the closure, wherein the engagement is achieved by sealing together the moveable part and the fixed part of the closure mechanism at one or more locations. This can be achieved by (1) welding, (2) gluing, or (3) taping of the plastic surfaces of both parts. For the taping a perforated adhesive film is used.

Here again, the initial opening and the closure with the welded, glued, or taped parts requires a defined threshold force. The force required for subsequent openings and closings of the container will be significantly lower since the sealing between the parts have been irreversibly destroyed after the initial opening. The container of the present invention does not intend to communicate to the consumer the existence or the location of the sealing between the closure parts. Thus, the breaking point is preferably located in an area not eminent to the user under normal storage and use.

Welding Materials and Process

In an embodiment of the present invention, non-limiting examples of common cap materials such as PP, high density polyethylene (HDPE), PET, PET-G, polyvinylchloride (PVC) may be used for the welding materials.

Figure 3:
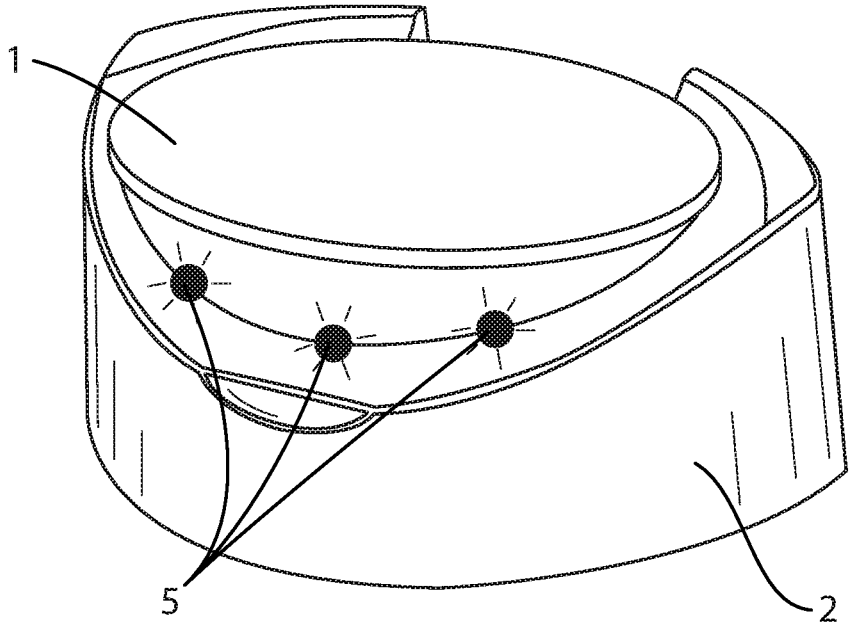
FIG. 3 is a view of a closure with laser welding dots (5) at the contact area between the base (2) and the moveable flip top (1) and is positioned on the outside of the closure.
Figure 4:
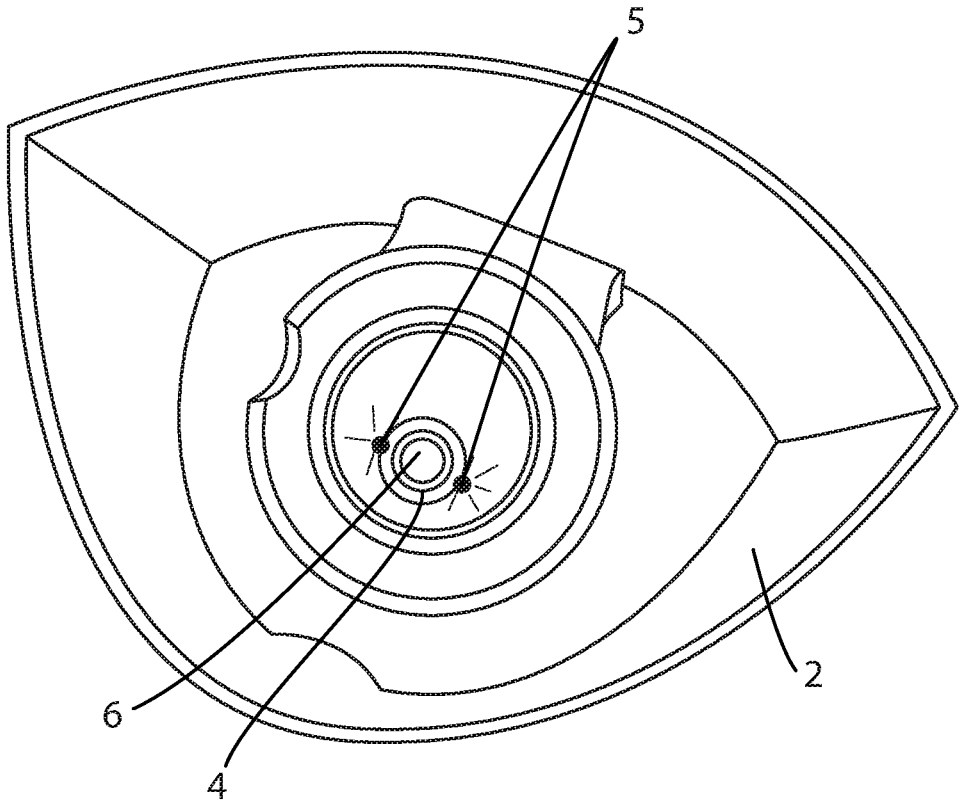
FIG. 4 is a view of a closure with laser welding dots (5) at the contact area between the base (2) and the moveable flip top (1) and is positioned on the inside of the closure and is positioned between the pin (6) and the orifice (4).
Figure 5A:
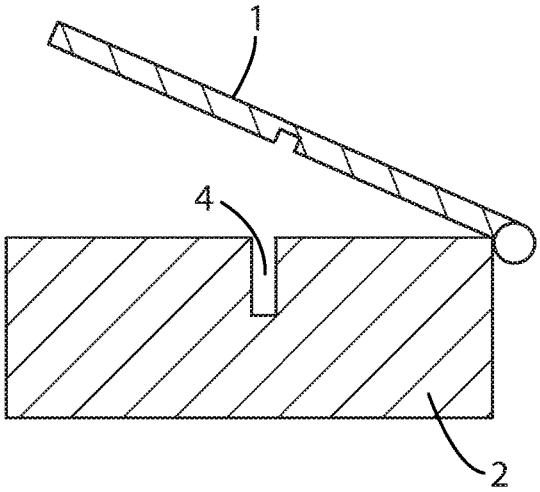
FIGS. 5A, 5B, 5C and 5D are views of closure having a breakable splint (7).
Figure 5B:
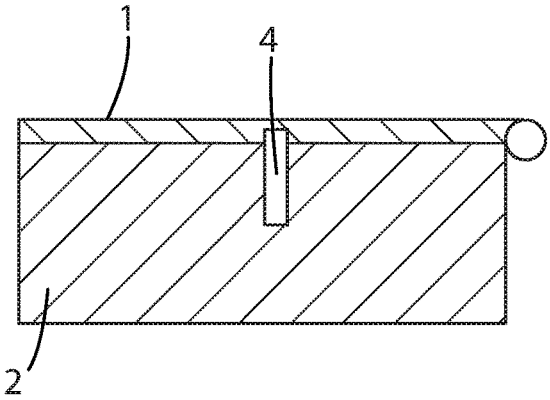
Figure 5C:
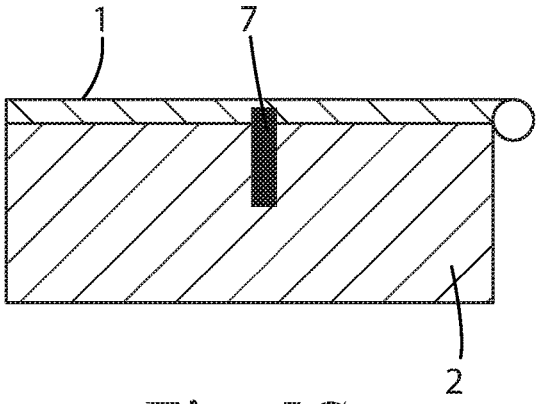
Figure 5D:
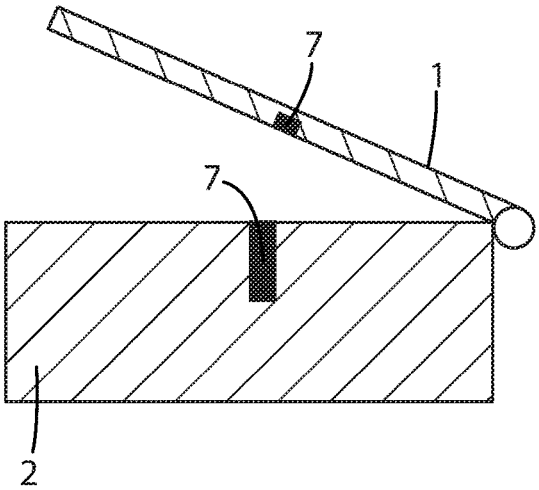
Figure 6:
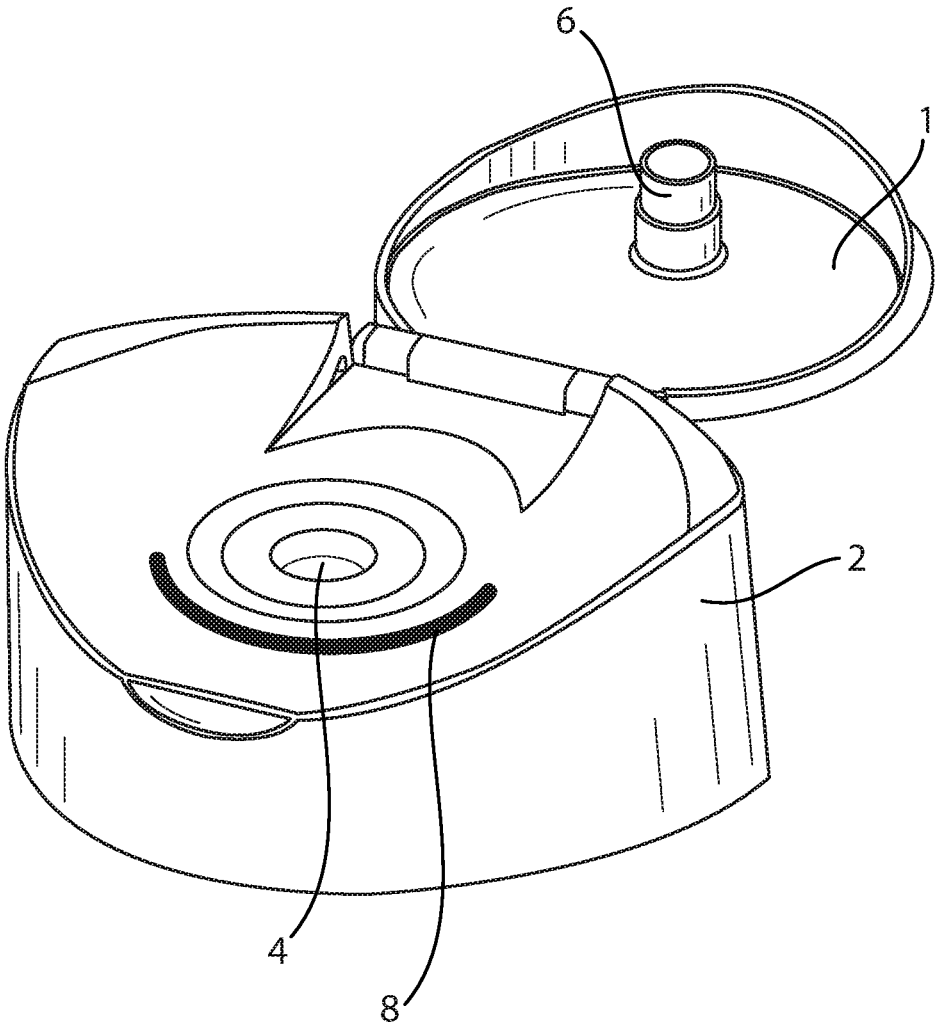
FIG. 6 is a view of a closure having a strip of glue with tack (8) applied to the base (2) of the closure. After closing of the movable flip top (1), the initial opening will require increased force to peel off the glue (8), and any subsequent opening will follow the normal default opening force.
Figure 7:
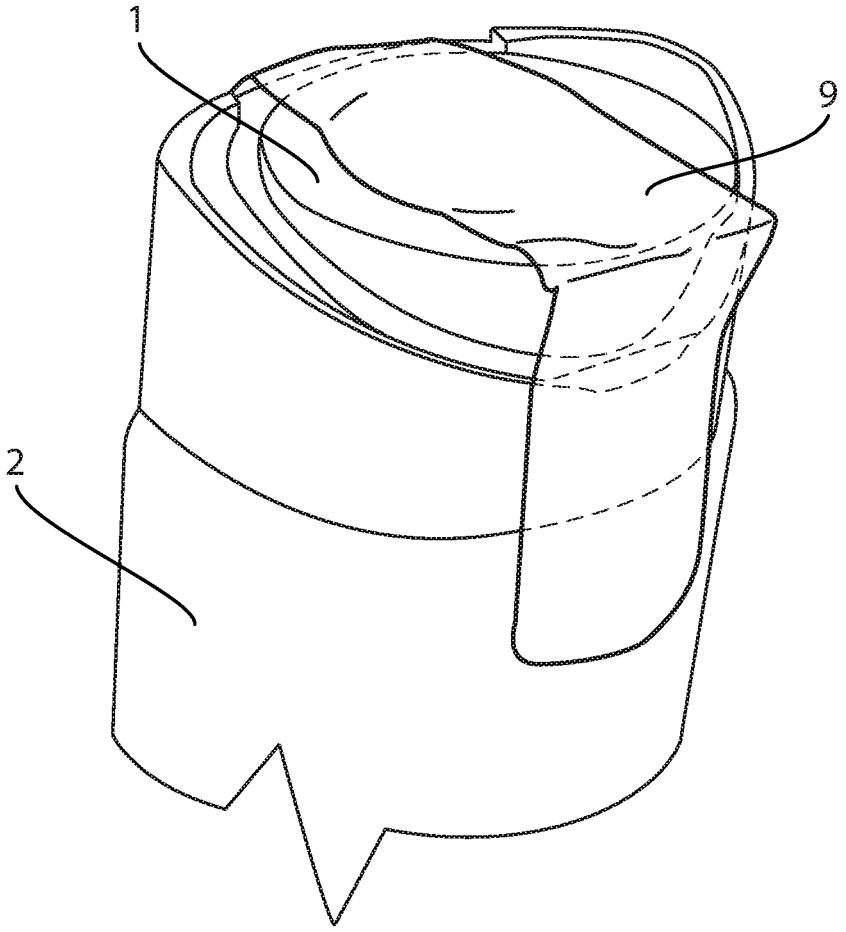
FIG. 7 is a view of a closure immobilized by application of an adhesive coated perforated film (9) wherein tape with a defined glue tack is applied to the movable flip top (1), starting from the back of the closure and ending in the front of the closure so the movable flip top (1) is immobilized. For initial opening, the tape is released or completely removed.

One embodiment of the sealing option is a disk closure or a movable flip top (1) closure wherein the sealing is achieved by welding together the moveable and fixed parts of the closure. The welding can be performed by the application of different commercially available energy sources such as (i) thermal energy (heating the surfaces), (ii) ultrasound, (iii) light, such as laser, or (iv) pressure such as compression of the surfaces. The application of energy softens or melts part of the plastic material of the closure, sealing together the moveable part and the fixed part of the closure in one or more locations. The location or locations of the welding event can be chosen based on the 3D geometry of the part. Welding can take place on the outside (consumer visible area, FIG. 3) of the cap or in the inside (invisible side, FIG. 4). One example, is the welding of the pin (6) inside the orifice (4). In one embodiment of the present invention, application of laser technology allows the welding of the two parts in a position inside the 3D contact area of the plastic parts (FIG. 4).

Another embodiment of the sealing option is a disk closure or a movable flip top (1) closure wherein the sealing is achieved by gluing together the moveable and fixed parts of the closure. This is achieved by applying, for example, a medium-tack glue or adhesive (8) to either or both of the surfaces. After closing at a defined pressure and respective curing time, the initial opening will require the intended one-time increase in opening force. The glue can be any commercially available glue suitable for the respective closure plastic material to provide the required tack that results in the desired opening force. Preferably, the glue will not enable a second round of adhesion after the initial opening and upon the in-use opening-closure cycles. A medium tack glue (8) is an adhesive with a defined holding/gluing force. Such adhesive is similar to this used in magazines to hold test samples of cosmetic product in sachets allowing the consumer to peel off the sample without damaging neither the magazine nor the sachet. Another common use for a reversible, medium tack glue are "Power Stripes" used to fix posters or lightweight pictures to walls, enabling residue free peel off after the intended usage.

Another embodiment of the sealing option is a disk closure or a movable flip top (1) closure wherein the sealing is achieved by taping an adhesive coated perforated film (9) onto lid and body of closure. Any commercially available perforated film can be used that is suitable for the respective closure plastic material that can provide the required results in the desired opening force. A perforated film is designed to have "holes" and "lands". Land is the area between the holes. The tearing force required to break the tape for opening the closure for the first time depends on a variety of factors including the material and thickness of the film, the ratio of holes and lands, and the distance between the holes. Thus, the perforated film can be designed to achieve the desired opening force.

Another embodiment of the sealing option is a disk closure or a movable flip top (1) closure wherein the sealing is achieved by utilizing a breakable splint (7) which connects the moveable part and the fixed part of the closure. This secures the tight closure during transport and storage. The closure having the splint can be manufactured with injection molding using a two-step process. The first step, injection molding step, results in a closure that includes a hollow space which spans in both the moveable and fixed parts of the closure at the closed position. The hollow space is filled in a subsequent second process step with liquid plastic by means of injection molding known to a person having ordinary skill in the art. The same or different polymer resin as the rest of the closure can be used for the filling. The filling solidifies or hardens upon cooling or upon thermosetting. After hardening of the plastic, it forms the splint. The splint is then broken during the initial opening of the closure, if sufficient force is used, that is, a force that is above a threshold value. The threshold value will depend on the geometry of the hollow space, the material of the splint and the process used.

Making a connection between the two parts of a closure by a conventional welding means, non-limiting examples of a welding means includes the following: all commercially available means of combining 2 plastic surfaces which are in close vicinity, by any kind of injection molded 3D design, physical connection of the polymer chains of the material both elements are comprised of or application of a specific adhesive capable of forming chemical bonds between both plastic surfaces. The energy source required for the physical connection of the polymer chains of the material both elements can be any commercially available source such as thermal energy (heat), laser light, ultrasound or pressure.

In an embodiment of the present invention, the welding station can be an independent UnitOp that just requires caps to be conveyed into it in an oriented way.

In an embodiment of the present invention, alternative welding technologies may be considered for use. Non-limiting examples include:

1. Laser-weld inside (pin to orifice) or outside (lid to body)
2. Thermo-weld (both positions possible as described for laser)
3. Ultrasound-weld (both positions possible as described for laser)
4. Apply medium tack glue between lid and body of closure (@cap maker, separate equipment) Apply peelable tape onto lid and body of closure (@cap maker OR production plant, separate equipment)

The part to be modified by the laser is fixed within a specifically designed fixture during the process: This allows the welding operation to be precisely executed at a defined spot of approx. 2×2 mm, positioned in the optimal surrounding based on the parts 3D geometry. For transparent parts, the welding position is chosen to be inside the plastic parts at the actual connection surface of the 2 parts. The laser beam is passing through the first layer of transparent plastic first and only releases the energy at the defined focus point inside the solid plastic part. For non-translucent plastic components, the zone of energy release is chosen to be outside the plastic parts but still in the area where the 2 elements acre in close vicinity. Depending on geometry and desired opening force, one or multiple laser welding dots (5) can be applied. Choice of laser type, wavelength and energy/ impulse duration are depending on the material characteristics of the parts to be welded.

EXAMPLES

Laser light is utilized to weld together the pin (6) with the hole of a pin-and-hole type with movable flip top (1) closure in a single position which is located in the interior of the closure. The closure is attached to a consumer product liquid container. The position of the welding results in the welding being invisible to the user of the container. The minimum force is required to initially open the container is measured using the method provided below and recorded. During this initial opening, the welding attachment is broken. Then, the force required to open the container after the initial opening is measured using the same equipment and recorded. The experiment is repeated 10 times and the average and standard deviation are calculated for both the required initial opening force as well as the required opening force after the initial opening. The collected data in the following table show that the required force for the initial opening is significantly higher than the force required to open the closure after the initial opening.

The same experimental protocol can be repeated in the case of a disc closure.

| | Minimum Force Required for Initial Opening (standard deviation) | Minimum Force Required for Subsequent Opening (standard deviation) |
|---|---|---|
| Sample 1 Current control flip top | 14 (2) | 8 (1) |
| Sample 2 Laser welded flip top | 37 (3) | 8 (1) |

| | Minimum Force Required for Initial Opening (standard deviation) | Minimum Force Required for Subsequent Opening (standard deviation) |
|---|---|---|
| Sample 1 - Flip top closure | 25 Newtons (7) | 11 Newtons (1) |

Method of Welding Via Laser

The parts to be welded using the laser are fixed within a specifically designed fixture during the process. This allows the welding operation to be precisely executed at a defined spot of approximately 2×2 mm, positioned in the optimal surrounding based on the parts 3D geometry. For translucent parts the welding position is chosen to be inside the plastic parts at the actual connection surface of the two parts. The laser beam passes through the first layer of transparent plastic first and only releases the energy at the defined focus point inside the solid plastic part. For non-translucent plastic components the zone of energy release is chosen to be outside the plastic parts but still in the area where the two elements are in close vicinity. Depending on geometry and desired opening force one or multiple laser welding dots (5) can be applied. Choice of laser type, wavelength and energy/impulse duration depend on the material characteristics of the parts to be welded. In a non-limiting example, PP Diode lasers with a wavelength of 990 nm, energy of 20 W and 0.1-0.3 sec impulse duration are used.

Method of Measuring Package Opening Force

The opening force of a package closure is measured using equipment having a load cell applicable to the expected force range. The equipment is capable of both tensile and compressive testing. A fixture is used to hold the container in place during the measurement. The package to be tested for opening force is placed at room temperature for a minimum of 4 hours before the measurement is performed.

For a flip top closure, a T-type tip is attached to the load cell. The T-type tip is positioned under the lift tab (or the lip) of the closure opposite to the hinge, The testing speed in which the T-type tip is move upwards is 225 mm per minute so that it pulls the closure open with a motion that maintains design intent. The T-type tip is allowed to travel a distance far enough to entirely open the closure. For the disc closure, the closure is fully opened and the force that is applied vertically to achieve the "open" position from the "closed" is measured. In all cases the highest force value detected during the measurement procedure is recorded. The process is repeated 10 times and the average is calculated.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed:

1. A closure comprising at least one engagement element that is breakable or irreversibly deformable upon application of an opening force that is equal to, or higher than, a threshold force value, wherein the closure comprises one or more moveable parts and one or more fixed parts; and wherein the engagement element engages one or more moveable parts and one or more of the fixed parts of the closure; and wherein the engagement element is selected from a group consisting of:

(a) a mechanical part which is attached to one or more of the moveable parts or one or more of the fixed part of the closure and wherein the mechanical part inhibits a separation between the moveable and the fixed part of the closure upon application of opening force below the threshold force value; and wherein the closure is a pin-and-hole flip top and the engagement element is a mechanical part attached to a lower part of a pin having a width larger than a width of an adjacent portion of the pin and wherein the mechanical part is breakable or irreversibly deformable upon application of an opening force that is equal to, or higher than, a threshold force value wherein the closure comprises a mushroom pin inserted through an orifice of the closure for dispensing and wherein the engagement element is not visible at a closed state of the container;

(b) sealing together one or more of the moveable parts and one or more of the fixed parts of the closure at one or more locations and wherein the engagement element is not visible at a closed state of the container wherein the sealing together of the moveable part and the fixed part of the closure is achieved by welding wherein the welding is produced by a light energy wherein the light is a laser;

(c) a breakable splint which connects one or more of the moveable and fixed parts of the closure created by a two step molding process wherein (1) a first step results in a closure that includes a hollow space which spans in both the moveable and the fixed parts of the closure at a closed position and wherein the engagement element is not visible at a closed state of the container and wherein (2) a second step includes a filling of the hollow space with a liquid plastic which solidifies or hardens upon cooling or upon thermosetting;

and wherein a ratio of the threshold force value to a required force to open the closure after an initial opening is larger than 1.25.

2. A closure according to claim 1, wherein the ratio of the threshold force value to the required force to open the closure after the initial opening is larger than 1.5.

3. A closure according to claim 1, wherein the ratio of the threshold force value to the required force to open the closure after the initial opening is larger than 2.

4. A closure according to claim 1, wherein the ratio of the threshold force value to the required force to open the closure after the initial opening is larger than 3.

5. A closure according to claim 1, wherein the ratio of the threshold force value to the required force to open the closure after the initial opening is larger than 4.

6. A closure according to claim 1, wherein the ratio of the threshold force value to the required force to open the closure after the initial opening is larger than 5.

7. A closure according to claim 1, wherein the threshold force required to open the closure for a first time is from 12 N to 50 N.

8. A closure according to claim 1, wherein the threshold force required to open the closure for a first time is from 18 N to 40 N.

9. A closure according to claim 1, wherein the threshold force required to open the closure for a first time is from 20 N to 35 N.

10. The closure according to claim 1, wherein the closure is constructed by a thermoplastic material.

11. The closure according to claim 1, wherein the closure is a flip top closure.

12. The closure according to claim 1, wherein the closure is a disk closure.

13. The closure according to claim 1, wherein the engagement element is a mechanical part which is attached to the moveable part of the closure.

14. The closure according to claim 13 wherein the engagement element is breakable.

15. The closure according to claim 1, wherein the engagement element is a sealing together of the moveable part and the fixed part of the closure at one or more locations.

16. The closure according to claim 15, wherein the sealing together of the moveable part and the fixed part of the closure is achieved by gluing.

17. The closure according to claim 16, wherein the sealing together of the moveable part and the fixed part of the closure is achieved by applying an adhesive after an injecting molding process and a hardening of material.

18. The closure according to claim 1, wherein the engagement element is a breakable splint which connects the moveable and fixed parts of the closure created by a two step molding process wherein (1) a first step results in a closure that includes a hollow space which spans in both the moveable and the fixed parts of the closure at a closed position and wherein (2) a second step includes the filling of the hollow space with a liquid plastic which solidifies or hardens upon cooling or upon thermosetting.

* * * * *